US007082654B2

(12) United States Patent
Snider et al.

(10) Patent No.: US 7,082,654 B2
(45) Date of Patent: Aug. 1, 2006

(54) NONWOVEN FABRICS HAVING INTERCALATED THREE-DIMENSIONAL IMAGES

(75) Inventors: Jerry Snider, Cornelius, NC (US); Andrew Delaney, East Windsor, NJ (US); Nick Carter, Mooresville, NC (US); Cheryl Carlson, Willow, NC (US); Julie Thompson, Loa Alamos, NM (US); Jennifer Mayhorn, Huntersville, NC (US)

(73) Assignee: Polymer Group, Inc., North Charleston, SC (US)

( * ) Notice: Subject to any disclaimer, the term of this patent is extended or adjusted under 35 U.S.C. 154(b) by 164 days.

(21) Appl. No.: 10/431,142

(22) Filed: May 7, 2003

(65) Prior Publication Data

US 2004/0029479 A1 Feb. 12, 2004

Related U.S. Application Data

(60) Provisional application No. 60/378,728, filed on May 8, 2002.

(51) Int. Cl.
*D04H 1/46* (2006.01)

(52) U.S. Cl. ..... 28/104; 28/106

(58) Field of Classification Search ..... 28/104, 28/105, 106, 167, 163; 442/408, 384
See application file for complete search history.

(56) References Cited

U.S. PATENT DOCUMENTS

| | | | | |
|---|---|---|---|---|
| 3,284,857 | A * | 11/1966 | Hynek | 28/105 |
| 3,485,706 | A | 12/1969 | Evans | |
| 5,098,764 | A | 3/1992 | Drelich et al. | |
| 5,244,711 | A | 9/1993 | Drelich et al. | |
| 5,301,401 | A * | 4/1994 | Suzuki et al. | 28/167 |
| 5,369,858 | A * | 12/1994 | Gilmore et al. | 28/104 |
| 5,475,903 | A | 12/1995 | Collins | |
| 5,674,591 | A | 10/1997 | James et al. | |
| 5,822,823 | A | 10/1998 | Polzin et al. | |
| 5,827,597 | A | 10/1998 | James et al. | |
| 6,502,288 | B1 * | 1/2003 | Black et al. | 28/104 |
| 6,509,079 | B1 * | 1/2003 | Suehr et al. | 428/113 |
| 6,669,799 | B1 * | 12/2003 | Putnam et al. | 156/148 |
| 2002/0034914 | A1 * | 3/2002 | De Leon et al. | 442/384 |
| 2003/0009862 | A1 * | 1/2003 | Black et al. | 28/104 |
| 2003/0019088 | A1 * | 1/2003 | Carter | 28/104 |

* cited by examiner

*Primary Examiner*—Amy B. Vanatta
(74) *Attorney, Agent, or Firm*—Wood, Phillips, Katz, Clark & Mortimer

(57) ABSTRACT

The present invention is directed to a method of forming a nonwoven fabric, which exhibits a plurality of three-dimensional images whereby the fabric is comprised of at least a first and second three-dimensional image that are dissimilar from one another. The three-dimensional images may be imparted into the fabric in a co-planar arrangement, multi-planar arrangement, or by utilizing both arrangements within the same fabric. Further, the present invention contemplates a fabric comprised of a plurality of three-dimensional images which can provide the fabric with various physical and/or aesthetic performances.

4 Claims, 9 Drawing Sheets

PRIOR ART

PRIOR ART

NONWOVEN FABRICS HAVING INTERCALATED THREE-DIMENSIONAL IMAGES

TECHNICAL FIELD

The present invention relates generally to methods of making nonwoven fabrics, and more particularly, to a method of manufacturing a nonwoven fabric comprising a plurality of interposed three-dimensional images whereby the fabric incorporates at least a first and a second three-dimensional image, said first three-dimensional image exhibiting a different performance and/or aesthetic attribute than said second three-dimensional image, wherein said first three-dimensional image is immediately presented within the second three-dimensional image.

BACKGROUND OF THE INVENTION

The production of conventional textile fabrics is known to be a complex, multi-step process. The production of fabrics from staple fibers begins with the carding process whereby the fibers are opened and aligned into a feedstock referred to in the art as "sliver". Several strands of sliver are then drawn multiple times on a drawing frames to; further align the fibers, blend, improve uniformity and reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference; with the use of such image transfer devices being desirable for providing a fabric with enhanced physical properties as well as an aesthetically pleasing appearance.

In circumstances whereby a single three-dimensional image is incapable or incongruous with satisfying the physical or aesthetic performances required, an unmet need exists for a product which exhibits two or more three-dimensional images, each image having different aesthetic or performance attributes. Further, it has been found that a multi-step fabrication process whereby a first image is imparted, followed by the application of a second image, is exceedingly problematic due to issues of registering the two different images, and changes in the ability of the constituent fibrous matrix to receive pronounced changes in three-dimensionality without obscuring the first imparted image. In addition, microporous drums, as well as, woven and/or embossed belts do not provide for sufficient finite fiber control to allow for the creation of high quality, useable materials. It is, therefore, an objective of the present invention to provide a method for manufacturing a nonwoven fabric whereby the fabric comprises at least a first and a second three-dimensional image, said first three-dimensional image exhibiting a different performance and/or aesthetic attribute than said second three-dimensional image, wherein said first three-dimensional image is intercalated immediately within the second three-dimensional image. The nonwoven fabric of the present invention is suitable for numerous home, medical and hygiene end-uses applications.

SUMMARY OF THE INVENTION

The present invention is directed to a method of forming a nonwoven fabric, which exhibits a plurality of three-dimensional images whereby the fabric is comprised of at least a first and second three-dimensional image that are dissimilar from one another. The three-dimensional images may be imparted into the fabric in a co-planar arrangement, multi-planar arrangement, or by utilizing both arrangements within the same fabric. Further, the present invention contemplates a fabric comprised of a plurality of three-dimensional images which can provide the fabric with various physical and/or aesthetic performances, for example; the first three-dimensional image may provide a physical performance, such as exfoliation or particulate entrainment, and the second three-dimensional image may serves as an aesthetic enhancement. It is also within the purview of the present invention that the first and second three-dimensional images may both provide a performance or an aesthetic enhancement. A particular representative fabric whereby two separate three-dimensional images, each image providing a different physical performance, are intercalated to form a material with a new or different performance is the combination of a first three-dimensional image providing exfoliation and a second three-dimensional image providing enhanced lather generation.

In accordance with the present invention, a method of making a nonwoven fabric includes the steps of providing a precursor web comprising a fibrous matrix. While use of staple length fibers is typical, the fibrous matrix may comprise substantially continuous filaments. In a particularly preferred form, the fibrous matrix comprises staple length fibers, which are carded and cross-lapped to form a precursor web. In one embodiment, the nonwoven fabric is a composite or laminate structure wherein the precursor web is comprised of one or more additional nonwoven layers, such as a support layer, a woven layer, such as a knit, or a film layer, such as a monolithic film.

In a particular embodiment envisioned by the present invention, the intercalated co-planar and/or multi-planar three-dimensional images of the resultant nonwoven fabric are adjoined to the background image of the fibrous substrate through fibrous bundles, referred to as fibrous transitions regions as specifically described in U.S. Pat. No. 5,674,591 to James et al., which is hereby incorporated by reference.

In a third embodiment, the nonwoven fabric of the invention comprises two different intercalated three-dimensional images, wherein at least one three-dimensional image comprises a repeating pattern of one or more apertures. The apertures may extend entirely or partially through the substrate, and/or may be distributed in an organized fashion or randomly scattered through out the resultant nonwoven fabric.

In a fourth embodiment, the nonwoven fabric of the invention comprises two different intercalated three-dimensional images, wherein one said three-dimensional image imparts a first woven or knit pattern and one said three-dimensional image imparts a different woven or knit pattern. For example, the present invention is capable of forming a nonwoven fabric having both left-hand and right-hand woven twill aesthetic properties interspersed throughout the continuous surface of the fabric, as represented in FIG. 16, or left-hand woven twill and tricot knit aesthetic properties, as represented in FIG. 17.

Subsequent to hydroentanglement, the three-dimensionally imaged fabric may be subjected to one or more variety of post-entanglement performance modifying treatments. Such treatments may include application of a polymeric binder composition, mechanical compacting, application of surfactant or electrostatic compositions, printing or dyeing, and like processes.

Optionally, subsequent to three-dimensional imaging, the imaged nonwoven fabric can be treated with one or more performance or aesthetic modifying composition to further alter the fabric structure or to meet end-use article requirements. A polymeric binder composition can be selected to enhance durability characteristics of the fabric, while maintaining the desired softness and drapeability of the three-dimensionally imaged fabric. A surfactant can be applied so as to impart hydrophilic properties. In addition, electrostatic modifying compound can be used to aid in cleaning or dusting applications.

Other features and advantages of the present invention will become readily apparent from the following detailed description, the accompanying drawings, and the appended claims.

DETAILED DESCRIPTION

Figure 1:
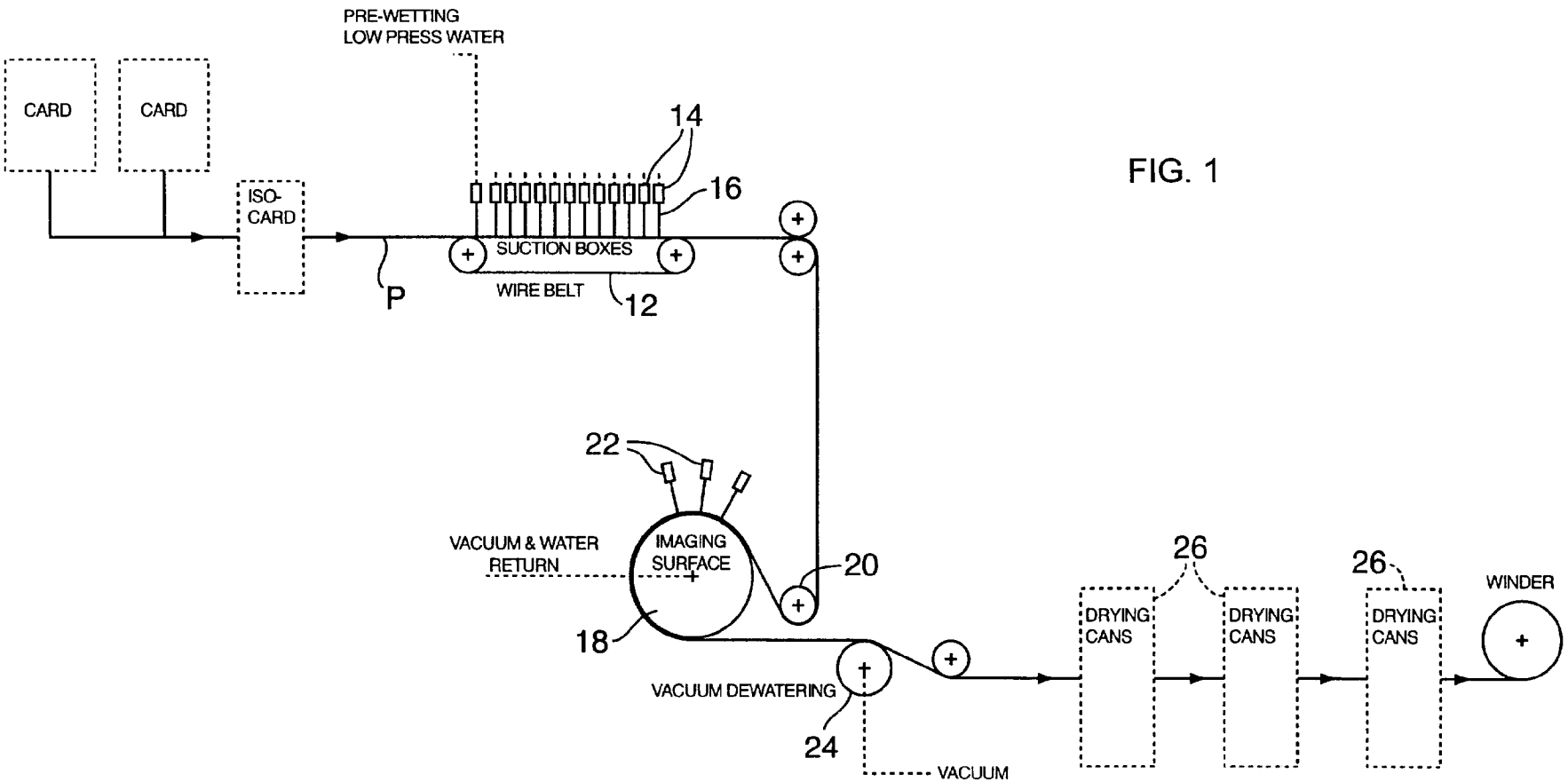
FIG. 1 is a diagrammatic view of an apparatus for manufacturing a durable nonwoven fabric, embodying the principles of the present invention.
Figure 2:
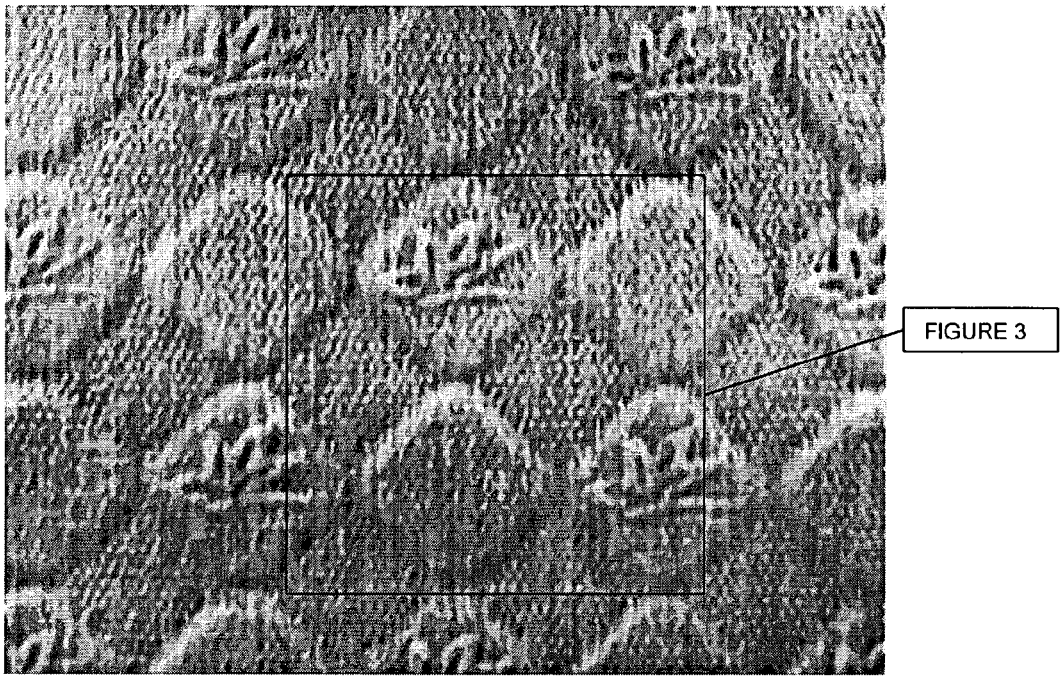
FIG. 2 is a photomicrograph of the fabric herein described in the present invention.
Figure 3:
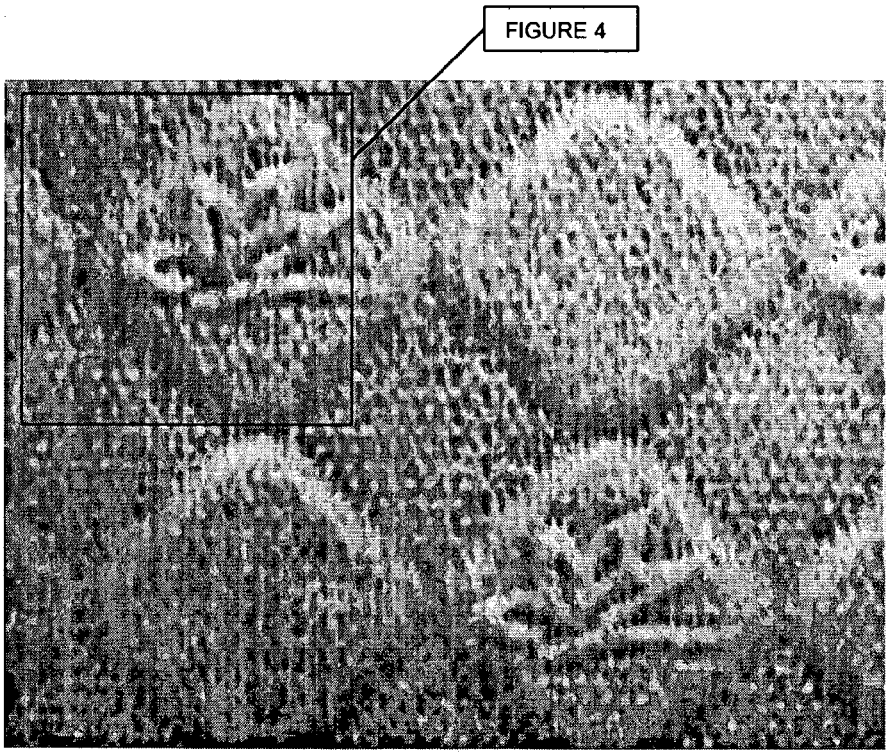
FIG. 3 is a photomicrograph of the fabric herein described in the present invention.
Figure 4:
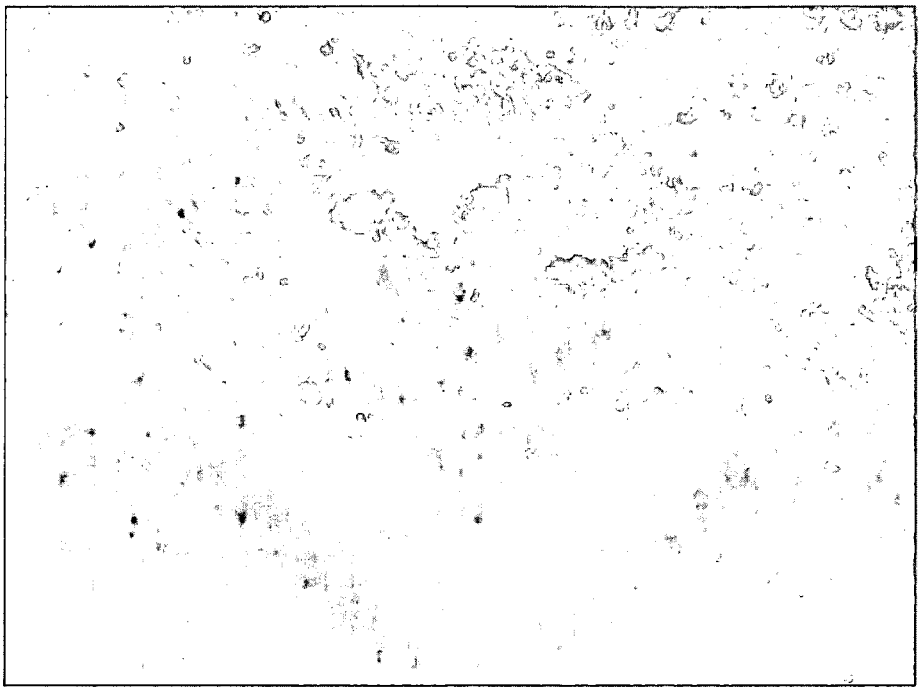
FIG. 4 is a photomicrograph of the fabric herein described in the present invention.
Figure 5:
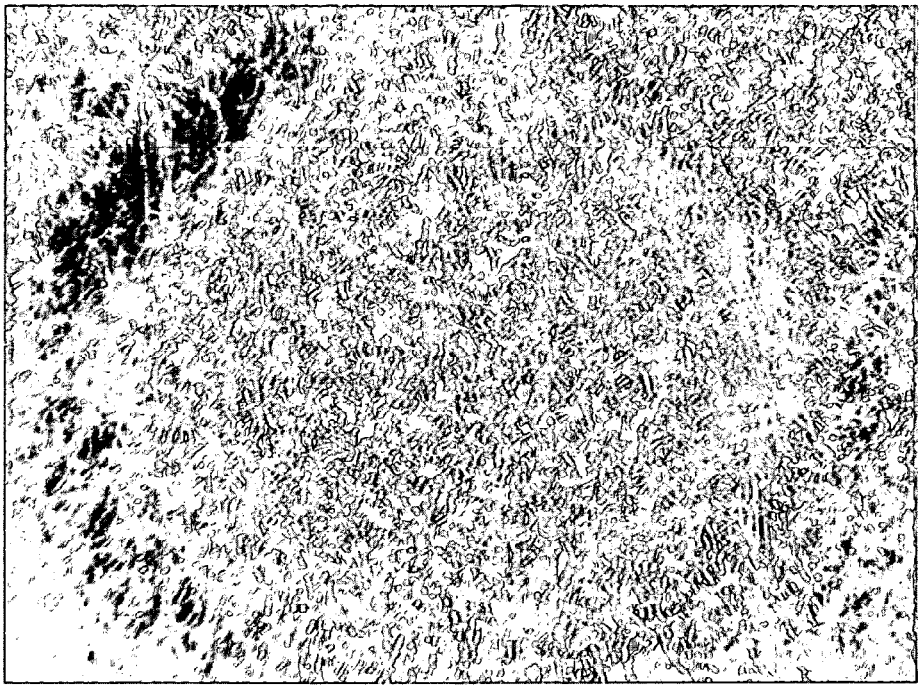
FIG. 5 is a photomicrograph of the prior art nonwoven fabric.
Figure 6:
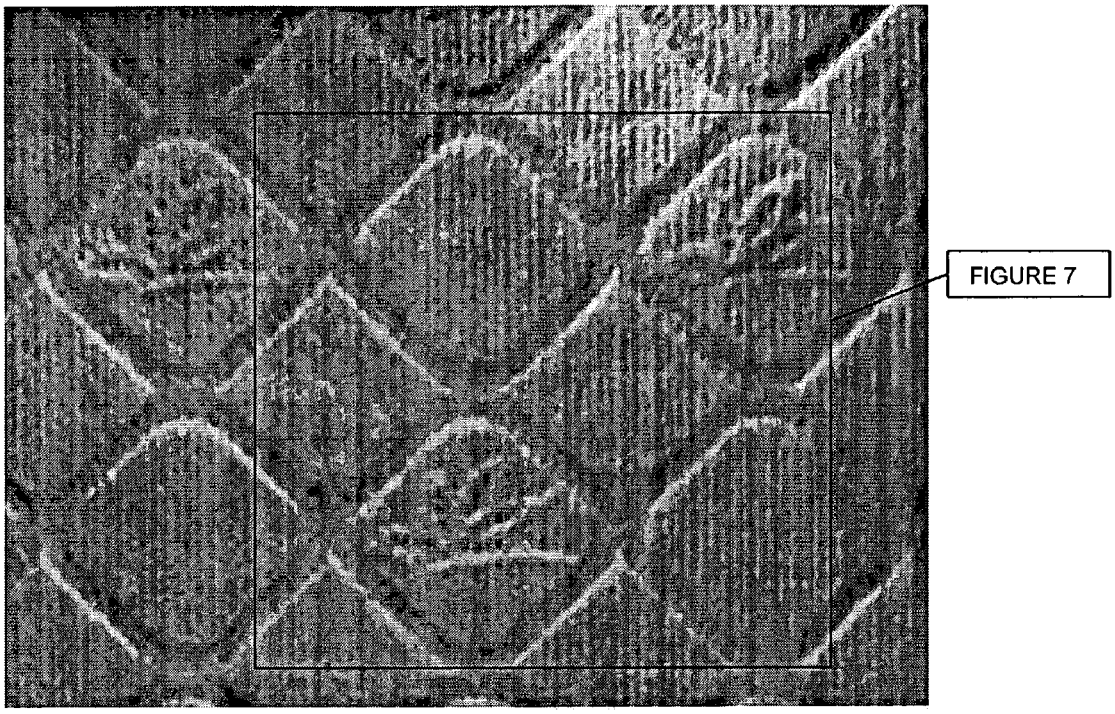
FIG. 6 is a photomicrograph of the fabric herein described in the present invention.
Figure 7:
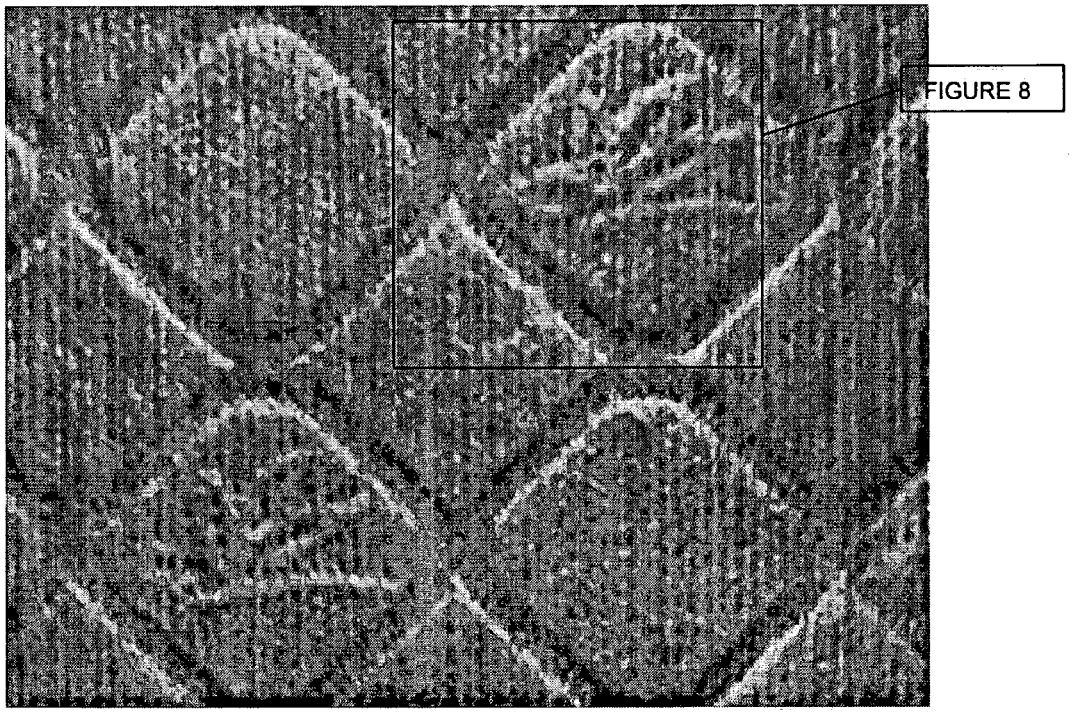
FIG. 7 is a photomicrograph of the fabric herein described in the present invention.
Figure 8:
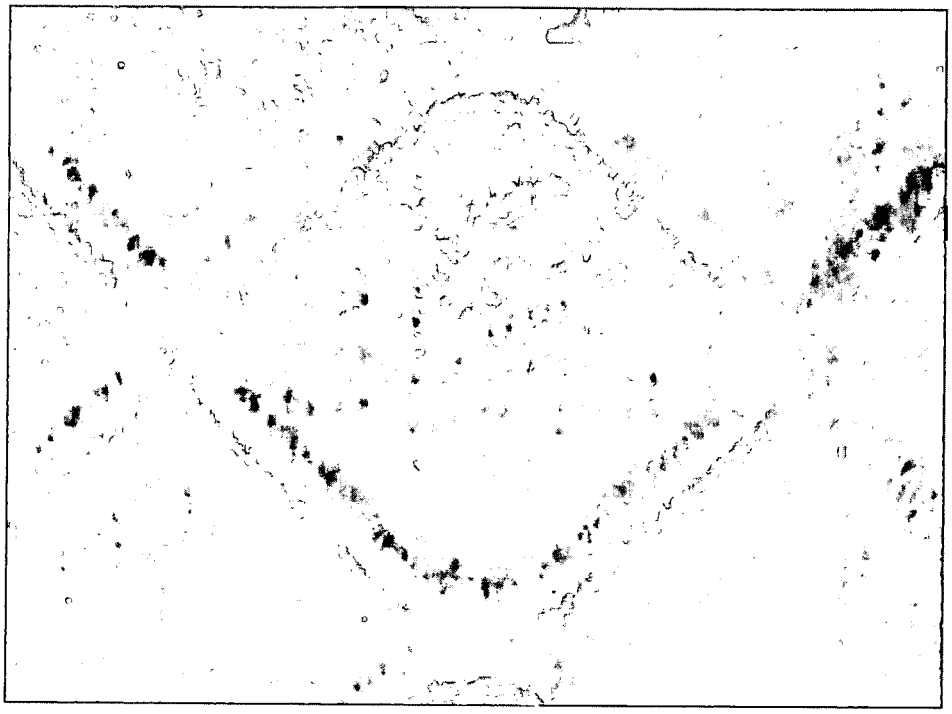
FIG. 8 is a photomicrograph of the fabric herein described in the present invention.
Figure 9:
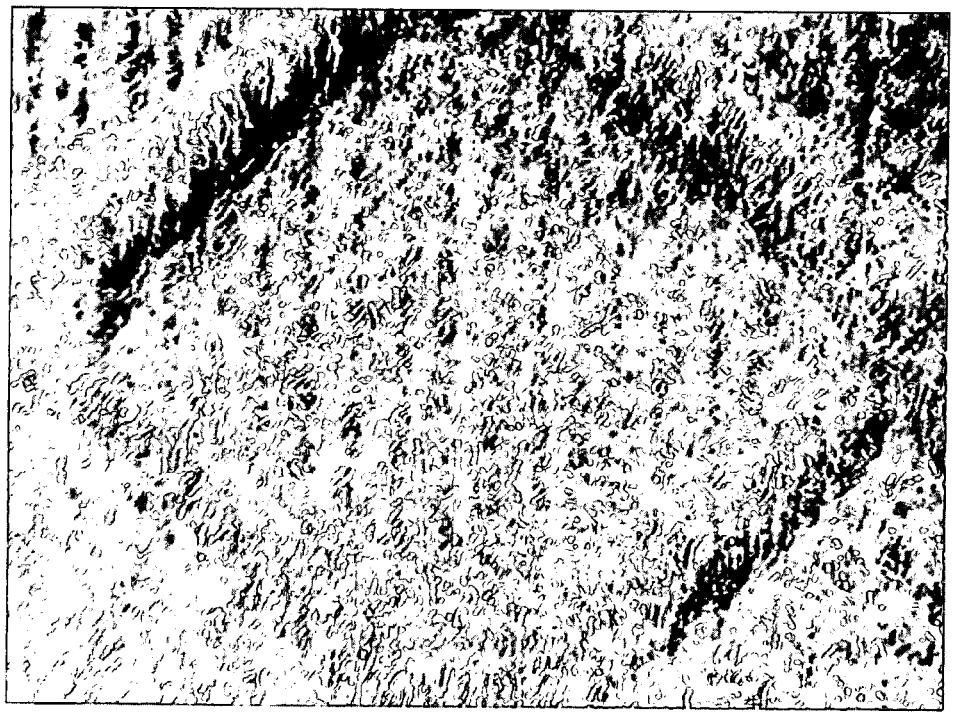
FIG. 9 is a photomicrograph of the prior art nonwoven fabric.
Figure 10:
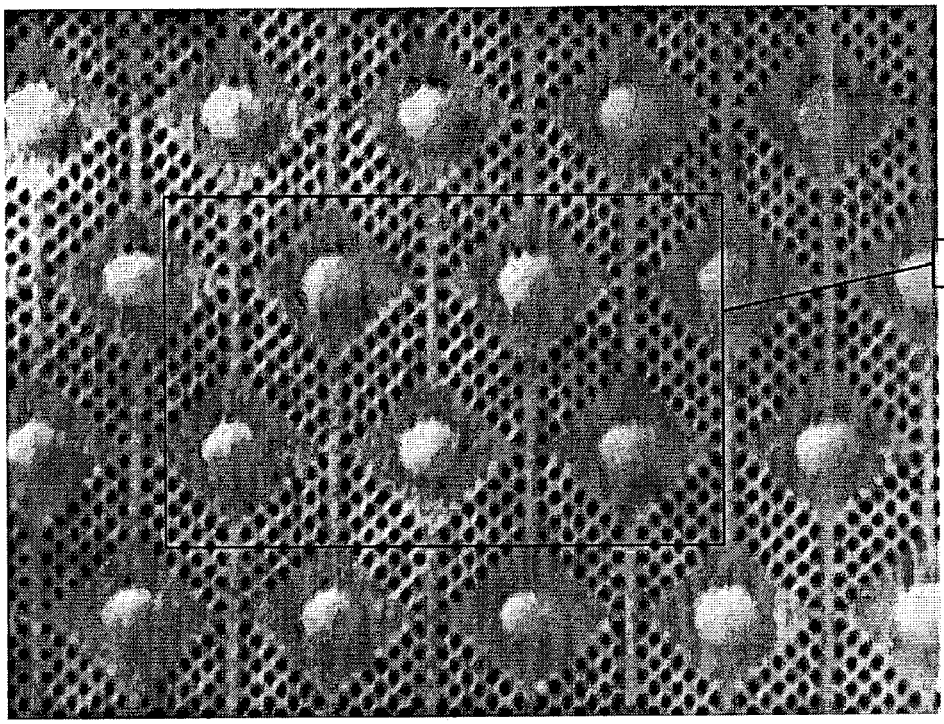
FIG. 10 is a photomicrograph of the fabric herein described in the present invention.
Figure 11:
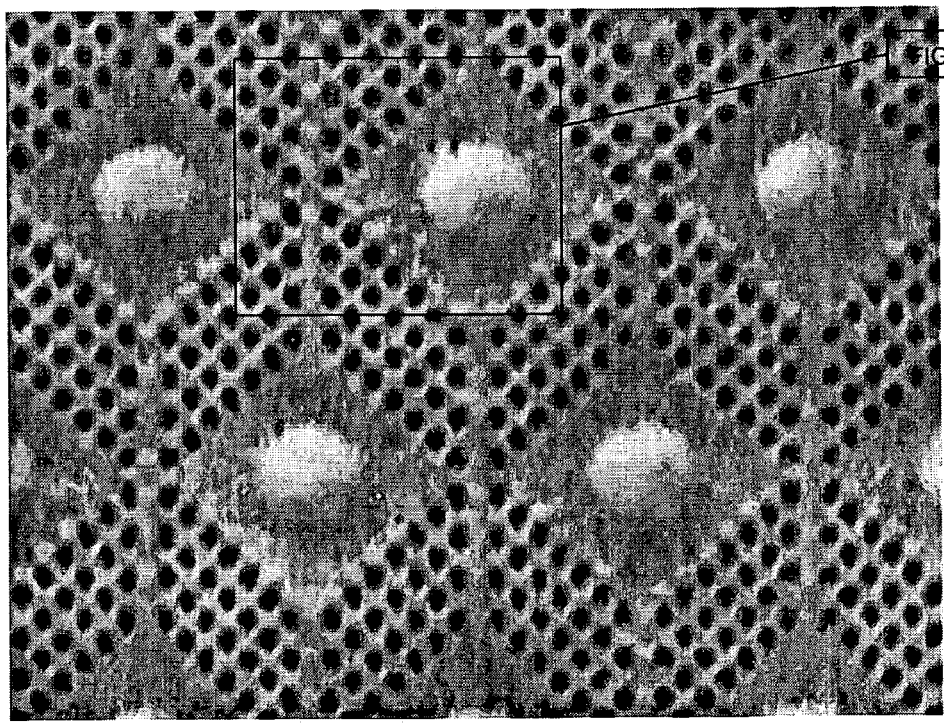
FIG. 11 is a photomicrograph of the fabric herein described in the present invention.
Figure 12:
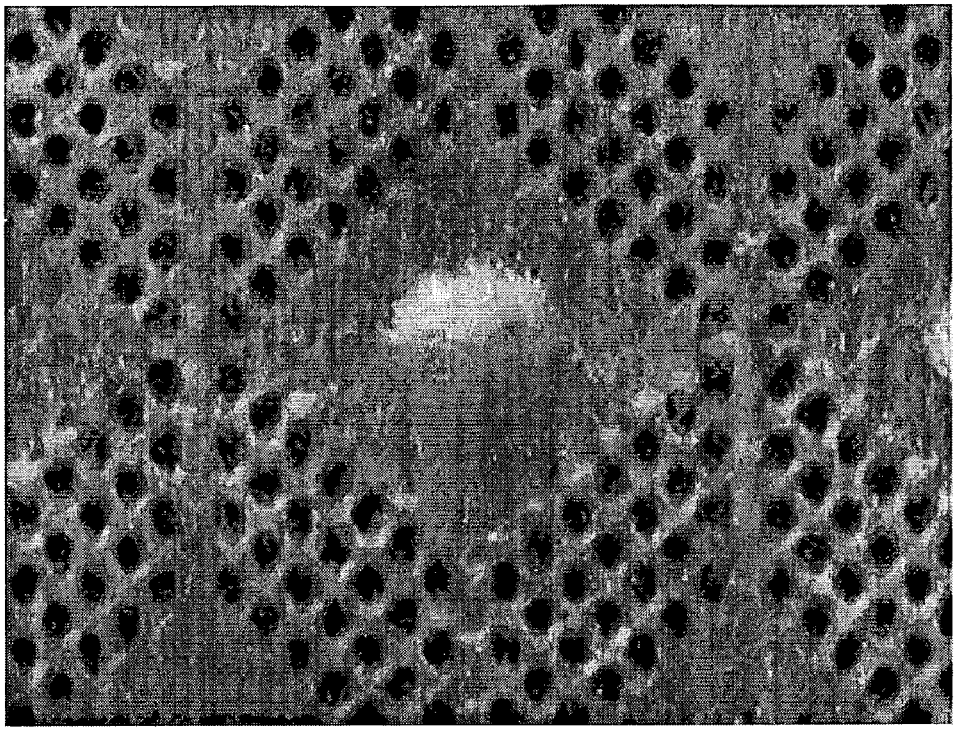
FIG. 12 is a photomicrograph of the fabric herein described in the present invention.
Figure 13:
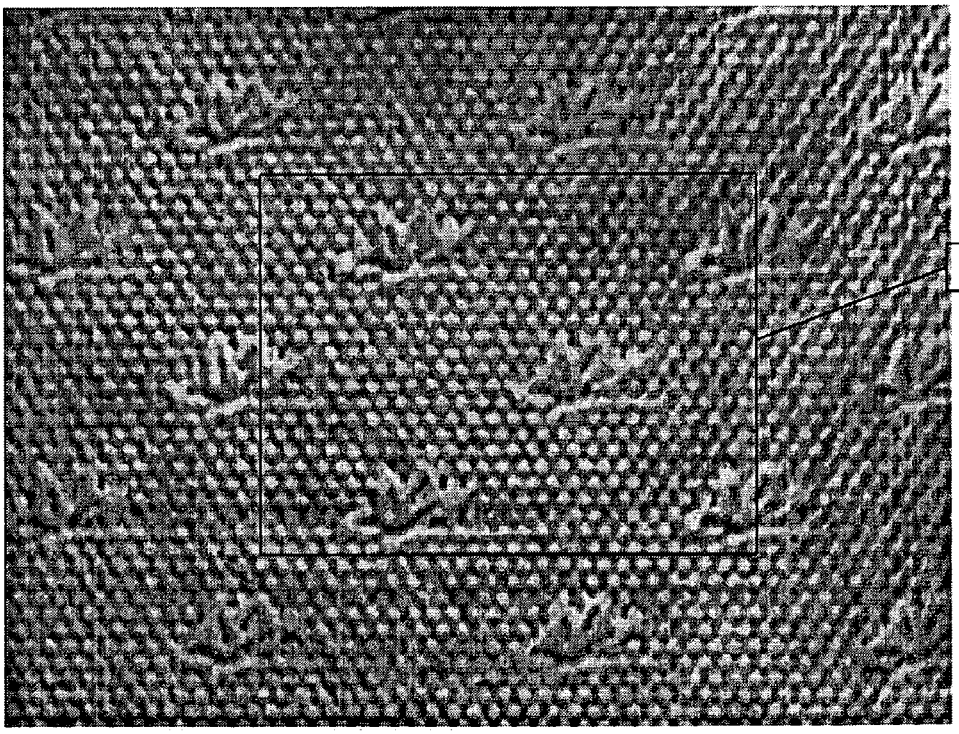
FIG. 13 is a photomicrograph of the fabric herein described in the present invention.
Figure 14:
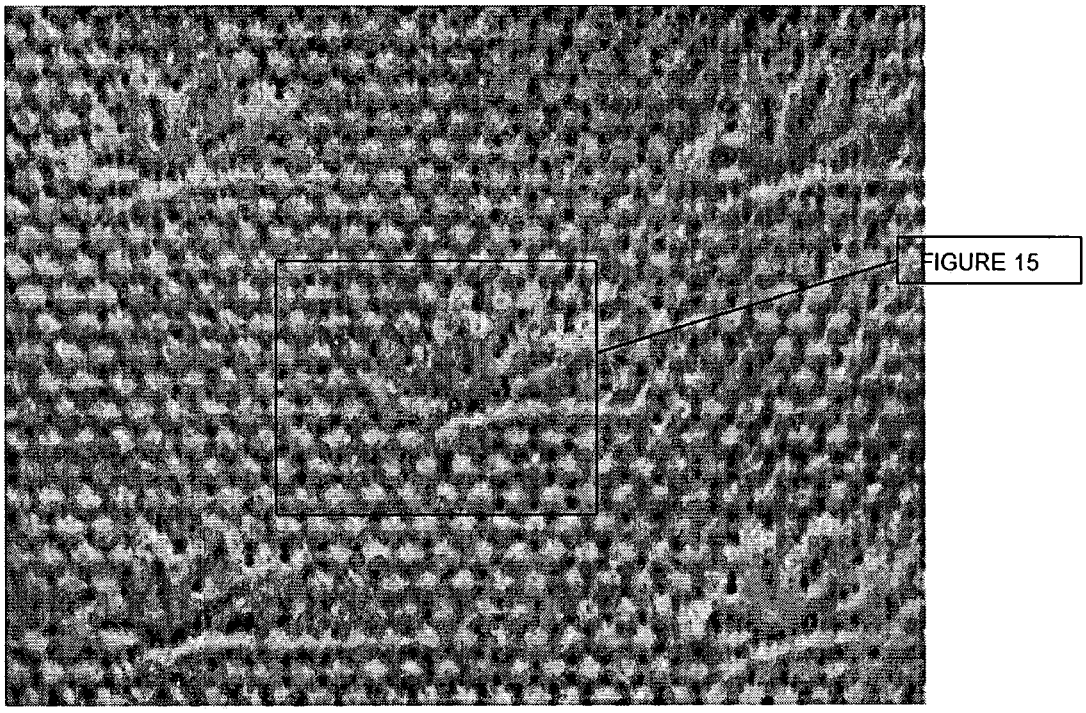
FIG. 14 is a photomicrograph of the fabric herein described in the present invention.
Figure 15:
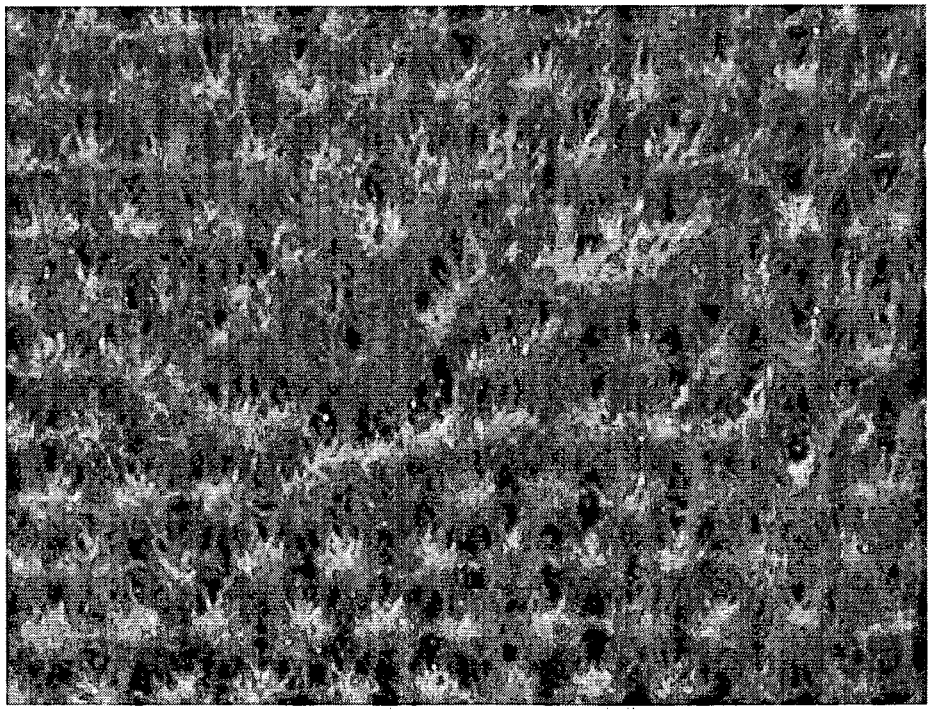
FIG. 15 is a photomicrograph of the fabric herein described in the present invention.
Figure 16:
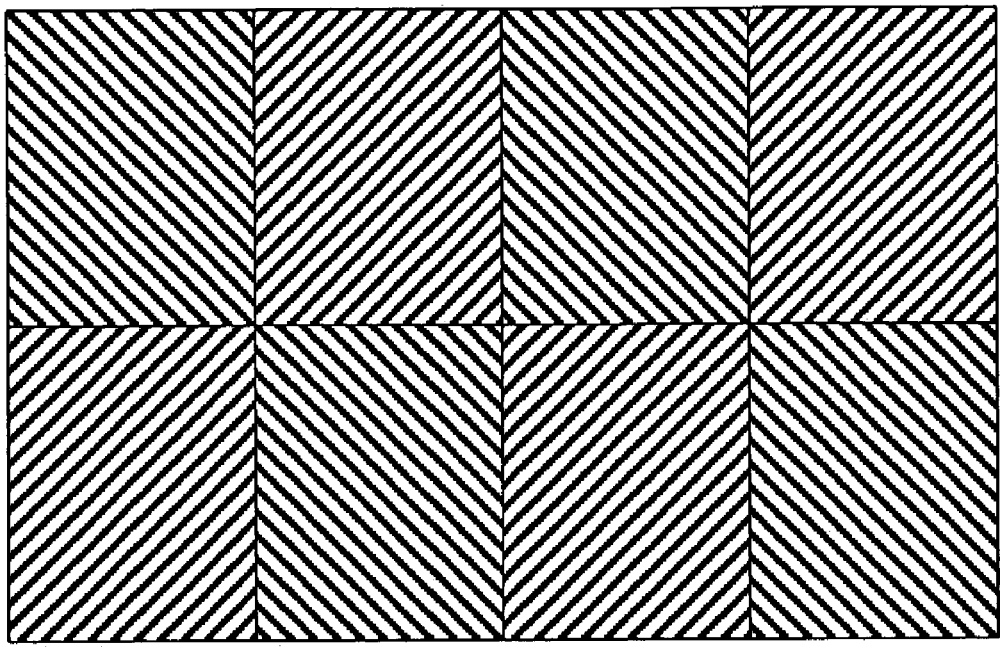
FIG. 16 is a top plan view of an image transfer device having a left-hand woven twill three-dimensional aesthetic property intercalated with a right-hand woven twill three-dimensional aesthetic property.
Figure 17:
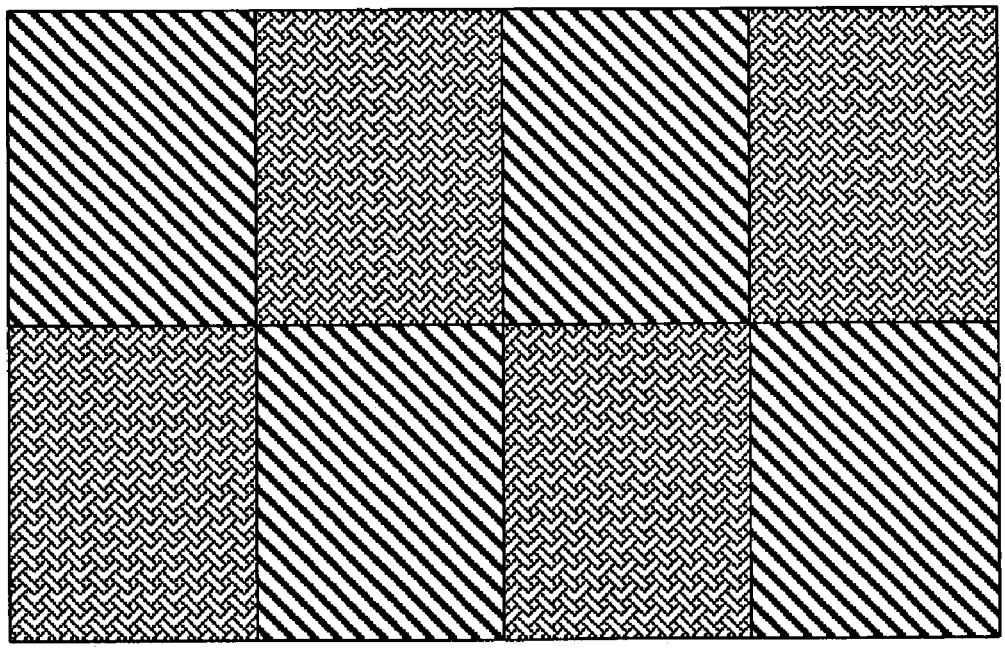
FIG. 17 is a top plan view of an image transfer device having a left-hand woven twill three-dimensional aesthetic property intercalated with tricot knit three-dimensional aesthetic property.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The present invention is directed to a method of forming a nonwoven fabric comprised of a plurality of three-dimensional images comprising at least a first three-dimensional image and a second three-dimensional image whereby the first and second three-dimensional images are dissimilar.

With reference to FIG. 1, therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

The apparatus of the present invention includes a foraminous forming surface in the form of a flat bed entangler 12 upon which the precursor web P is positioned for pre-entangling. Precursor web P is then sequentially passed under entangling manifolds 14, whereby the precursor web is subjected to high-pressure water jets 16. This process is well known to those skilled in the art and is generally taught by U.S. Pat. No. 3,485,706, to Evans, hereby incorporated by reference.

The entangling apparatus of FIG. 1 further includes an imaging and patterning drum 18 comprising a three-dimensional image transfer device for effecting imaging and patterning of the now-entangled precursor web. The three-dimensional image transfer device of the present invention comprises at least two dissimilar images embedded within the imaging movable surface. After pre-entangling, the precursor web is trained over a guide roller 20 and directed to the image transfer device 18, where a plurality of three-dimensional images are imparted into the fabric on the foraminous forming surface of the device. The web of fibers is juxtaposed to the image transfer device 18, and high pressure water from manifolds 22 is directed against the outwardly facing surface from jet spaced radially outwardly of the image transfer device 18. The image transfer device 18, and manifolds 22, may be formed and operated in accordance with the teachings of commonly assigned U.S. Pat. No. 4,098,764, No. 5,244,711, No. 5,822,823, and No. 5,827,597, the disclosures of which are hereby incorporated by reference. The entangled fabric can be vacuum dewatered at 24, and dried at an elevated temperature on drying cans 26.

The nonwoven fabric of the present invention may be a composite, laminate, single layer or multiple layers in order to incorporate support and/or absorbent mechanisms into the imaged fabric. The plurality of three-dimensional images can provide the fabric with various attributes, for example, the first three-dimensional image may provide a performance attribute and the second three-dimensional image may serves as an aesthetic enhancement, the first and second three-dimensional images may both provide a performance, wherein the two different images may have the same or different performance, or the first and second three-dimensional images may both provide for aesthetic enhancement of the over all resultant nonwoven fabric.

The plurality of three-dimensional images intercalated within the nonwoven fabric can be arranged either co-planar to one another, multi-planar to one another, or arranged co-planar as well as multi-planar to one another. Optionally, the intercalated three-dimensional images of the resultant nonwoven fabric can be adjoined to the background of the fibrous substrate or adjoined to an underlying three-dimensional image through fibrous bundles, referred to as fibrous transitions regions as previously mentioned.

It is within the purview of present invention that the nonwoven fabric can comprises two different intercalated three-dimensional images, wherein at least one three-dimensional image comprises a repeating pattern of one or more apertures. The apertures may extend entirely or partially through the substrate, and/or may be distributed in an organized fashion or randomly scattered through out the resultant nonwoven fabric.

The nonwoven fabric can be further modified aesthetically through subsequent dyeing, and printing, or by using colored fibers during the manufacturing step, to achieve the affects of the desired nonwoven fabric.

Manufacture of a nonwoven fabric comprised of a plurality of three-dimensional images embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, reconstituted cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 2.0 to 8 denier being preferred for general applications. The profile of the fiber and/or filament is not a limitation to the applicability of the present invention.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a nonwoven fabric comprising at least two intercalated three-dimensional images, comprising the steps of:

providing a nonwoven precursor web;

providing a three-dimensional image transfer device having a movable imaging surface having at least two dissimilar images embedded within the movable imaging surface, including a first three-dimensional image and a second three-dimensional image;

advancing said nonwoven precursor web onto said three-dimensional transfer device; and applying hydraulic energy to said nonwoven precursor web to simultaneously entangle and impart at least said first three-dimensional image within said second three-dimensional image into said web so as to form a nonwoven fabric with intercalated three-dimensional images, wherein one of said first and second three-dimensional images imparted to said web comprises a repeating pattern of apertures.

2. A method of making a nonwoven fabric comprising at least two intercalated three-dimensional images in accordance with claim 1, wherein said precursor web comprises staple length fibers.

3. A method of making a nonwoven fabric comprising at least two intercalated three-dimensional images in accordance with claim 1, wherein said precursor web comprises substantially continuous filaments.

4. A method of making a nonwoven fabric comprising at least two intercalated three-dimensional images, comprising the steps of:

providing a precursor web formed from staple length fibers;

providing a three-dimensional image transfer device having a movable imaging surface having at least two dissimilar images embedded within the movable imaging surface, including a first three-dimensional image and a second three-dimensional image;

advancing said precursor web onto said three-dimensional transfer device; and applying hydrauiic energy to said precursor web to simultaneously entangle and impart at least said first three-dimensional image within said second three-dimensional image into said web so as to form a nonwoven fabric with intercalated three-dimensional images, wherein one of said first and second three-dimensional images imparted to said web comprises a repeating pattern of apertures.

* * * * *